US009169712B2

(12) United States Patent
Jahnke

(10) Patent No.: US 9,169,712 B2
(45) Date of Patent: Oct. 27, 2015

(54) BLOWOUT PREVENTER LOCKING DOOR ASSEMBLY AND METHOD OF USING SAME

(71) Applicant: National Oilwell Varco, L.P., Houston, TX (US)

(72) Inventor: Douglas A. Jahnke, Houston, TX (US)

(73) Assignee: National Oilwell Varco, L.P., Houston, TX (US)

( * ) Notice: Subject to any disclaimer, the term of this patent is extended or adjusted under 35 U.S.C. 154(b) by 220 days.

(21) Appl. No.: 13/860,376

(22) Filed: Apr. 10, 2013

(65) Prior Publication Data

US 2013/0264502 A1 Oct. 10, 2013

Related U.S. Application Data

(60) Provisional application No. 61/622,443, filed on Apr. 10, 2012.

(51) Int. Cl.
*E21B 33/06* (2006.01)
*E06B 5/00* (2006.01)

(52) U.S. Cl.
CPC ..... *E21B 33/061* (2013.01); *E06B 5/00* (2013.01); *E21B 33/062* (2013.01)

(58) Field of Classification Search
CPC ..... E21B 33/06; E21B 33/061; E21B 33/062; E21B 33/063; E21B 33/064
USPC ..... 251/1.1, 1.2, 1.3
See application file for complete search history.

(56) References Cited

U.S. PATENT DOCUMENTS

| | | | |
|---|---|---|---|
| 3,242,826 | A | 3/1966 | Smith |
| 3,272,222 | A | 9/1966 | Allen |
| 3,670,761 | A | 6/1972 | Lerouax |
| 3,791,616 | A | 2/1974 | Lerouax |

(Continued)

FOREIGN PATENT DOCUMENTS

| | | |
|---|---|---|
| CN | 201250636 | 6/2009 |
| DE | 3317487 | 11/1984 |

(Continued)

OTHER PUBLICATIONS

International Search Report for PCT Patent Application No. PCT/US2013/036001 dated May 23, 2014, 5 pages.

(Continued)

*Primary Examiner* — Marina Tietjen
*Assistant Examiner* — Daphne M Barry
(74) *Attorney, Agent, or Firm* — JL Salazar Law Firm

(57) ABSTRACT

A locking door assembly, blowout preventer and method are provided. The blowout preventer is for sealing about a tubular extending from a wellbore of a wellsite. The blowout preventer includes a housing having a bore and a channel therethrough. The tubular is positionable through the bore and engageable therein. The blowout preventer also includes a door assembly including a door slidably positionable along an axis of the channel and providing selective access to the channel, and a lock. The lock includes at least one locking member having at least one raised portion extending along the door assembly in a direction transverse to the axis of the channel. The locking member is extendable into at least one corresponding receptacle of the housing and movable thereallong between an unlocked and a locked position whereby the door assembly is selectively retractable from the housing.

22 Claims, 9 Drawing Sheets

(56) References Cited

U.S. PATENT DOCUMENTS

| | | | | |
|---|---|---|---|---|
| 3,871,613 | A | 3/1975 | Lerouax | |
| 3,918,478 | A | 11/1975 | Lerouax | |
| 3,941,141 | A | 3/1976 | Robert | |
| 3,946,806 | A | 3/1976 | Meynier, III | |
| 4,052,995 | A | 10/1977 | Ellison | |
| 4,076,208 | A | 2/1978 | Olson | |
| 4,185,856 | A * | 1/1980 | McCaskill | 285/18 |
| 4,188,860 | A | 2/1980 | Miller | |
| 4,253,638 | A | 3/1981 | Troxell, Jr. | |
| 4,290,577 | A | 9/1981 | Olson | |
| 4,305,565 | A | 12/1981 | Abbe | |
| 4,437,643 | A | 3/1984 | Brakhage, Jr. et al. | |
| 4,438,900 | A | 3/1984 | Schaeper et al. | |
| 4,456,215 | A | 6/1984 | Bishop et al. | |
| 4,492,359 | A | 1/1985 | Baugh | |
| 4,502,534 | A | 3/1985 | Roche et al. | |
| 4,504,037 | A | 3/1985 | Beam et al. | |
| 4,519,577 | A | 5/1985 | Jones | |
| 4,558,842 | A | 12/1985 | Peil et al. | |
| 4,582,293 | A * | 4/1986 | Jones | 251/1.3 |
| 4,601,232 | A | 7/1986 | Troxell, Jr. | |
| 4,647,002 | A | 3/1987 | Crutchfield | |
| 4,877,217 | A | 10/1989 | Peil et al. | |
| 4,969,390 | A | 11/1990 | Williams, III | |
| 4,969,627 | A | 11/1990 | Williams, III | |
| 5,025,708 | A | 6/1991 | Smith et al. | |
| 5,056,418 | A | 10/1991 | Granger et al. | |
| 5,063,828 | A | 11/1991 | Kamimura et al. | |
| 5,199,683 | A | 4/1993 | Le | |
| 5,217,073 | A | 6/1993 | Bruns | |
| 5,255,890 | A | 10/1993 | Morrill | |
| 5,400,857 | A | 3/1995 | Whitby et al. | |
| 5,505,426 | A | 4/1996 | Whitby et al. | |
| 5,515,916 | A | 5/1996 | Haley | |
| 5,575,452 | A | 11/1996 | Whitby et al. | |
| 5,653,418 | A | 8/1997 | Olson | |
| 5,662,171 | A | 9/1997 | Brugman et al. | |
| 5,735,502 | A | 4/1998 | Levett et al. | |
| 5,897,094 | A | 4/1999 | Brugman et al. | |
| 5,918,851 | A | 7/1999 | Whitby | |
| 5,975,484 | A | 11/1999 | Brugman et al. | |
| 6,173,770 | B1 | 1/2001 | Morrill | |
| 6,374,925 | B1 | 4/2002 | Elkins et al. | |
| 6,510,897 | B2 | 1/2003 | Hemphill | |
| 6,554,247 | B2 | 4/2003 | Berckenhoff et al. | |
| 6,782,799 | B2 | 8/2004 | Vincent | |
| 6,857,634 | B2 | 2/2005 | Araujo | |
| 6,969,042 | B2 | 11/2005 | Gaydos | |
| 7,044,430 | B2 | 5/2006 | Brugman et al. | |
| 7,051,989 | B2 | 5/2006 | Springett et al. | |
| 7,051,990 | B2 | 5/2006 | Springett et al. | |
| 7,195,224 | B2 | 3/2007 | Le | |
| 7,243,713 | B2 | 7/2007 | Isaacks et al. | |
| 7,246,666 | B2 | 7/2007 | Hmphill et al. | |
| 7,331,562 | B2 | 2/2008 | Springett | |
| 7,413,019 | B2 | 8/2008 | Hemphill et al. | |
| 7,798,466 | B2 | 9/2010 | Springett et al. | |
| 8,225,857 | B2 | 7/2012 | Yadav et al. | |
| 8,979,070 | B2 * | 3/2015 | Keizer et al. | 251/367 |
| 2002/0162981 | A1 | 11/2002 | Berckenhoff et al. | |
| 2004/0021269 | A1 | 2/2004 | Gaudette et al. | |
| 2004/0084644 | A1 | 5/2004 | Wiedemann | |
| 2004/0222239 | A1 | 11/2004 | Kinder | |
| 2006/0021749 | A1 | 2/2006 | Schaeper | |
| 2006/0113501 | A1 | 6/2006 | Isaacks et al. | |
| 2008/0265188 | A1 | 10/2008 | Springett et al. | |
| 2009/0056132 | A1 | 3/2009 | Foote | |
| 2010/0155080 | A1 | 6/2010 | Cargaugh et al. | |

FOREIGN PATENT DOCUMENTS

| | | |
|---|---|---|
| GB | 1352258 | 5/1974 |
| GB | 1352260 | 5/1974 |
| GB | 2100773 | 1/1983 |
| GB | 2154265 | 9/1985 |
| WO | 2005106188 | 11/2005 |

OTHER PUBLICATIONS

International Preliminary Report on Patentability and Written Opinion for PCT Patent Application No. PCT/ US2011/051472 dated Mar. 19, 2013, 6 pages.

Notification of Transmittal of the International Search Report and the Written Opinionof the International Searching Authority, or the Declaration, International Search Report, and Written opinion of the International Searching Authority, Feb. 12, 2013, PCT/US2011/051472, 11 pages.

* cited by examiner

BLOWOUT PREVENTER LOCKING DOOR ASSEMBLY AND METHOD OF USING SAME

BACKGROUND

This present disclosure relates generally to techniques for performing wellsite operations. More specifically, the present disclosure relates to techniques for preventing blowouts involving, for example, a blowout preventer, ram assembly, a door assembly, and/or a lock.

Oilfield operations may be performed to locate and gather valuable downhole fluids. Oil rigs are positioned at wellsites, and downhole tools, such as drilling tools, are deployed into the ground to reach subsurface reservoirs. Once the downhole tools form a wellbore to reach a desired reservoir, casings may be cemented into place within the wellbore, and the wellbore completed to initiate production of fluids from the reservoir. Downhole tubular devices may be positioned in the wellbore to enable the passage of subsurface fluids to the surface.

Leakage of subsurface fluids may pose an environmental threat if released from the wellbore. Equipment, such as blow out preventers (BOPs), may be positioned about the wellbore to form a seal about a tubular therein to prevent leakage of fluid as it is brought to the surface. BOPs may have selectively actuatable rams or ram bonnets, such as pipe rams or shear rams, that may be activated to seal and/or sever a tubular in a wellbore. Some examples of BOPs are provided in U.S. Patent/Application Nos. 20110000670; 7,814,979; and 7,367,396.

It may be desirable to provide BOPs with various features, such as seals, ram blocks, doors and/or lock mechanisms, etc., for use in wellsite operations. Examples of BOPs and/or features may be provided in U.S. patent application Ser. Nos.13/018,217 (not yet published at the time of filing), US 2010/0243926, US2011/0012311, U.S.Pat. Nos.5,897,094; 7,044, 430; 7,051,989, 5,575,452, WO 2012/012192, WO 2012/012193, U.S. Pat. Nos. 7,195,224 and 7,798,466.

SUMMARY

In at least one aspect, the disclosure relates to a door assembly for accessing a blowout preventer of a wellsite. The blowout preventer is for sealing about a tubular extending from a wellbore of the wellsite, and includes a housing having a bore and a channel therethrough. The tubular is positionable through the bore and severable therein. The door assembly includes a door slidably positionable along an axis of the channel and providing selective access to the channel, and a lock. The lock includes at least one locking member having at least one raised portion extending along the door assembly in a direction transverse to the axis of the channel. The locking member is extendable into at least one corresponding receptacle of the housing and movable therealong between an unlocked and a locked position whereby the door assembly is selectively retractable from the housing.

The locking member may include at least one locking plate having a plurality teeth, the teeth including a plurality of door teeth and a plurality of housing teeth on opposite sides thereof. The door teeth are engageable with the door. The housing teeth are engageable with the housing. The teeth may be distributed in discrete rows. The discrete rows may have trenches therebetween. The locking member is slidably movable between the locked position with the teeth of the locking member in non-alignment with the trenches of the housing or the door assembly and the unlocked position with the teeth of the locking member in alignment with the trenches of the teeth of the housing or door assembly.

The number of teeth of the housing and a number of teeth of the locking member may be the same or different. The teeth may have a polygonal shape, triangular shape, trapezoidal shape, and/or a round shape. The teeth may be at an acute angle to the axis of the channel. The locking member may include a pair of locking members on opposite sides of the door. The lock may also include a pair of lock supports operatively connecting the pair of lock plates about the door assembly. The locking member may include a locking ball.

In another aspect the disclosure relates to a blowout preventer for sealing about a tubular extending from a wellbore of the wellsite. The blowout preventer includes a housing having a bore and a channel therethrough, the tubular positionable through the bore and severable therein, and the door assembly positionable about an opening of the channel of the housing.

The blowout preventer may also include a ram block with a ram shaft extended therefrom through the door assembly and into a ram cylinder. The ram block may be slidably movable through the channel of the housing and sealingly engageable with the tubular. The blowout preventer may also include an actuator operatively connectable to the ram cylinder.

In yet another aspect, the disclosure relates to a method of accessing the blowout preventer of a wellsite. The method involves providing the door assembly about the blowout preventer, selectively retracting the door assembly from the housing by movably positioning the at least one raised portion along the at least one corresponding receptacle of the housing between the locked and unlocked position.

The raised portion may include a plurality of teeth and the selectively retracting may involve slidably moving the plurality of teeth of the locking member between the locked position in non-alignment with the trenches of the plurality of teeth of the housing and the unlocked position in alignment with trenches in the housing. The method may also involve slidably positioning a ram assembly in the channel of the housing. The ram assembly includes a ram block with a ram shaft extended therefrom through the door assembly and into a ram cylinder. The method also involves accessing the ram assembly by retracting the door assembly. The method may also involve slidingly moving the ram block slidably through the channel of the housing and in sealing engagement with the tubular.

The disclosure may also relate to a blowout preventer for sealing about a tubular. The blowout preventer includes a housing and a door assembly. The housing has a bore and a channel therethrough, the tubular positionable through the bore. The door assembly is positionable about an opening of the housing and provides selective access to the channel therein. The door assembly includes a plurality of teeth extendable into the housing and lockingly engageable therewith.

The disclosure may also relate to a method of sealing a tubular. The method involves positioning the blowout preventer about a wellbore, positioning the tubular through the bore of the housing, and positioning the door assembly about the opening of the housing such that the teeth extend into the housing and lockingly engage therewith.

BRIEF DESCRIPTION OF THE DRAWINGS

So that the above recited features and advantages of the present disclosure can be understood in detail, a more particular description of the disclosure, briefly summarized above, may be had by reference to the embodiments thereof that are illustrated in the appended drawings. It is to be noted, however, that the appended drawings illustrate only typical embodiments and are, therefore, not to be considered limiting of its scope. The figures are not necessarily to scale and certain features, and certain views of the figures may be shown exaggerated in scale or in schematic in the interest of clarity and conciseness.

DETAILED DESCRIPTION

The description that follows includes exemplary apparatus, methods, techniques, and/or instruction sequences that embody techniques of the present subject matter. However, it is understood that the described embodiments may be practiced without these specific details.

Blowout preventers (BOPs) may be positioned about a tubular to provide a seal therewith, for example, during a blowout. To access portions of the BOP and/or components therein, the BOP may be provided with a door assembly to provide selective access thereto. Due to, for example, high pressures and temperatures in operating conditions, the door assembly may be provided with a lock that provides selective access and maintains the door assembly in a sealed, closed position during operation of the BOP. The lock may be in the form of a pair of lock plates with a plurality of teeth slidably positionable in selective locking engagement with a housing of the BOP.

Figure 1:
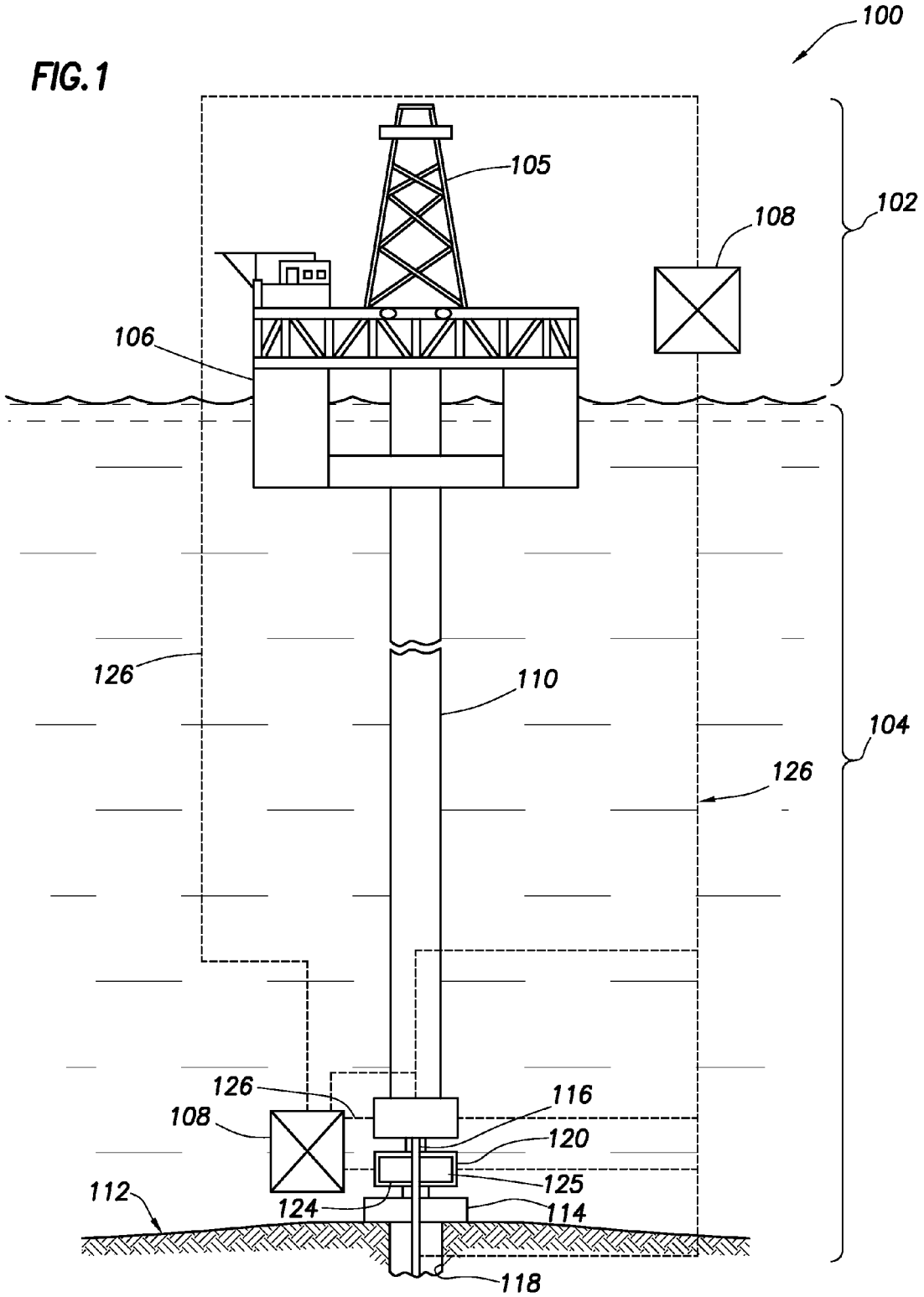
FIG. 1 depicts a schematic view of an offshore wellsite having a blowout preventer (BOP) with a ram assembly and a locking door assembly.

FIG. 1 depicts an offshore wellsite 100 having a subsea system 104 and a surface system 102. The surface system 102 may be used to facilitate oilfield operations at the offshore wellsite 100. The surface system 102 may include a rig 105, a platform 106 (or vessel) and a controller 108.

The subsea system 104 includes a conduit (e.g., riser) 110 extending from the platform 106 to a sea floor 112. The subsea system further includes a wellhead 114 with a tubular 116 extending into a wellbore 118, a BOP 120 and a controller 108. The BOP 120 has various BOP components, such as a ram assembly 124 for shearing the tubular 116 and sealing the wellbore 118. The ram assembly 124 is engageable with the tubular 116 to form a seal about the tubular and/or to sever or cut the tubular 116. The BOP 120 also has a door assembly 125 with a lock for providing selective access into the BOP as will be described more fully herein.

The surface system 102 and subsea system 104 may be provided with one or more controllers 108 located at various locations to control the surface system 102 and/or the subsea systems 104. Communication links 126 may be provided for communication between the controllers 108 and various parts of the wellsite 100.

Although the BOP 120 is described herein as being used in subsea operations, it will be appreciated that the wellsite 100 may be land or water based, and the BOP 120 and/or door assembly 125 may be used in any wellsite environment. The BOP 120 may sever and/or seal a tubular device, such as tubular 116. 'Tubular devices' as used herein refers to tubular members or devices, such as pipes, certain downhole tools, casings, drill pipe, liner, coiled tubing, production tubing, wireline, slickline, or other tubular members positioned in the wellbore, and associated components, such as drill collars, tool joints, drill bits, logging tools, packers, and the like (referred to as 'tubulars' or 'tubular strings').

Figure 2A:
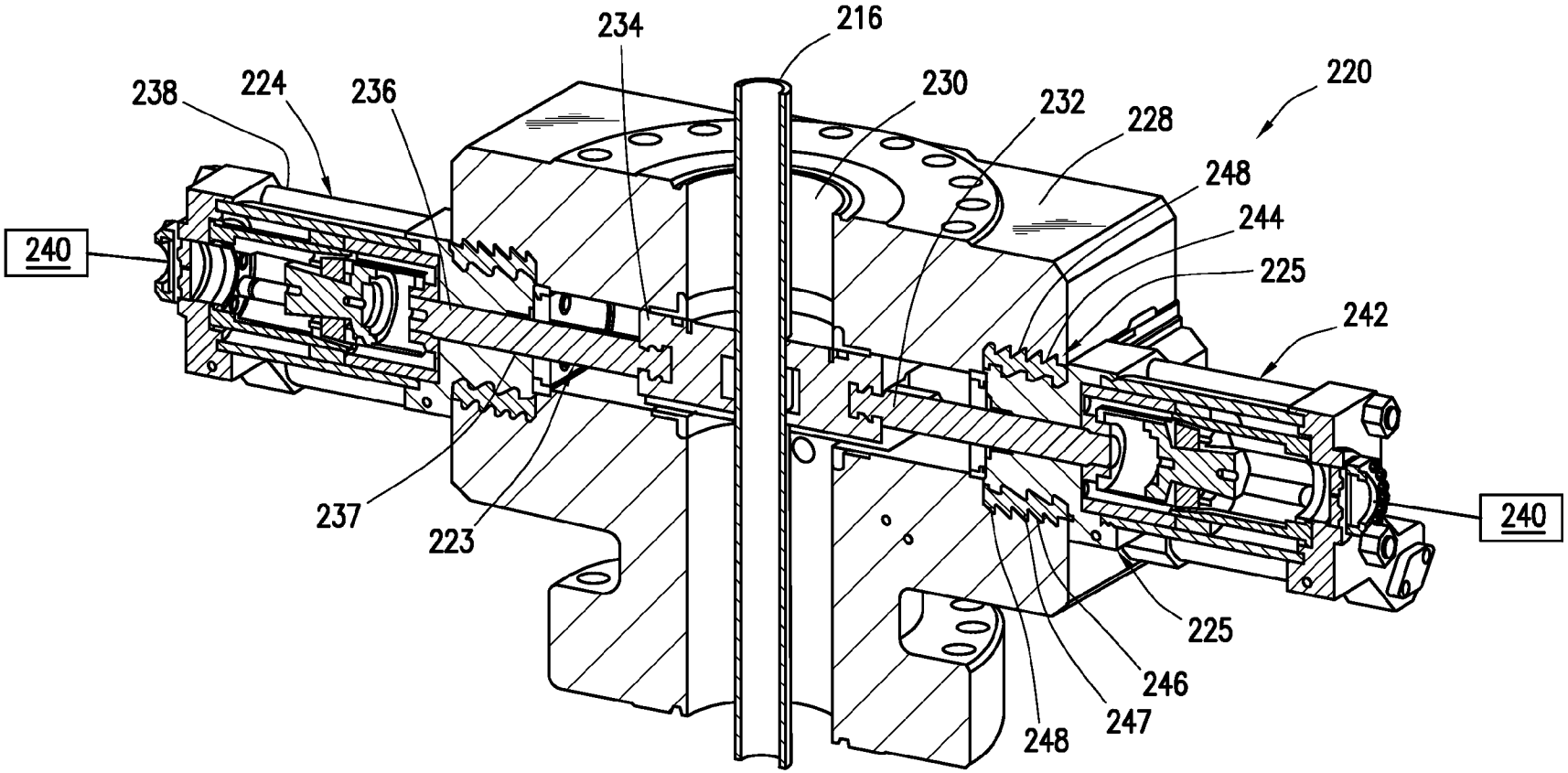
FIGS. 2A-2B depict vertical cross-sectional views of a BOP with a ram assembly in a sealed and an unsealed position, respectively.
Figure 2B:
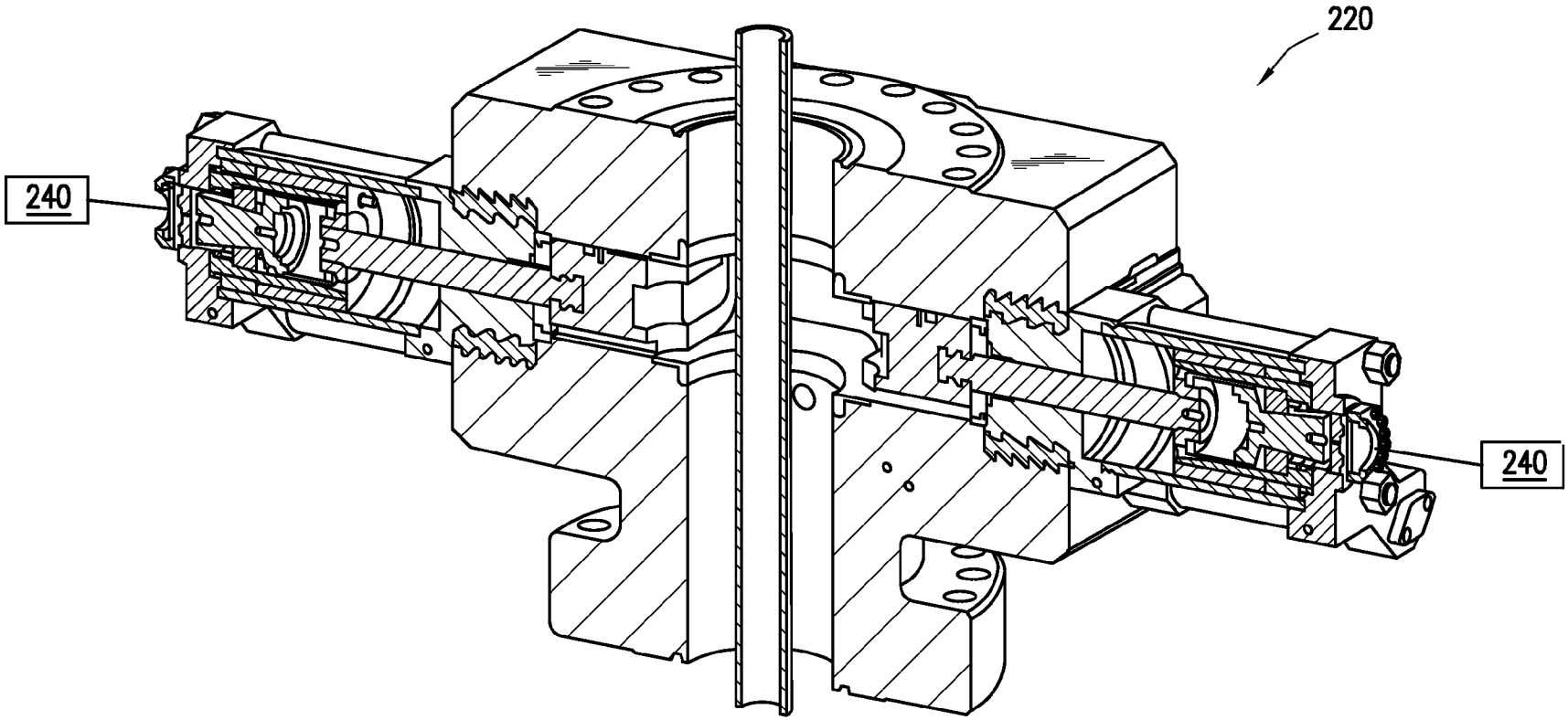
Figure 3:
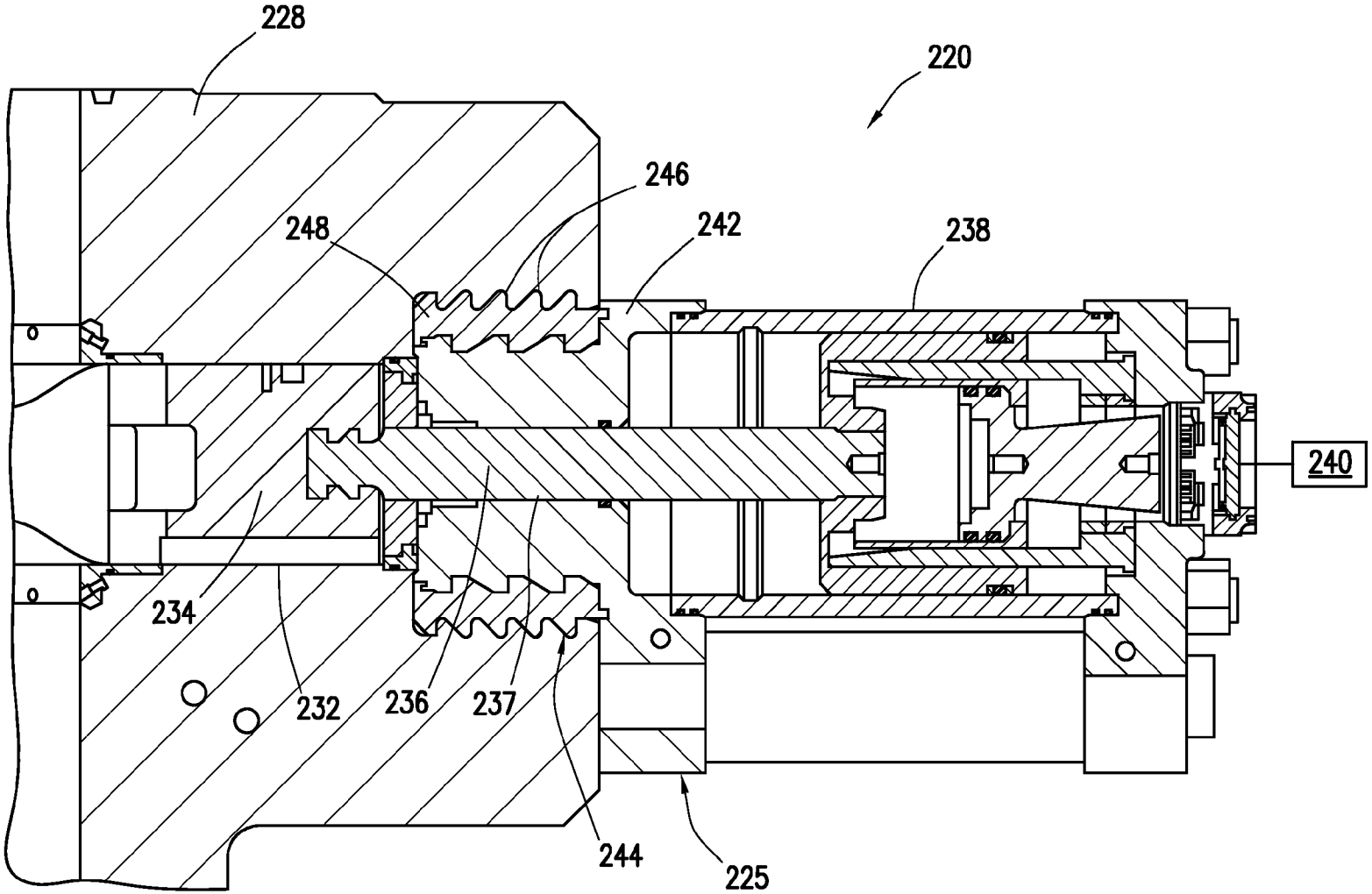
FIG. 3 depicts a horizontal cross-sectional view of a BOP with a ram assembly in the unsealed position.

FIGS. 2A, 2B and 3 depict various views of a BOP 220 with a ram assembly and a door assembly with a lock. FIGS. 2A, 2B depict longitudinal cross-sectional views of a BOP 220 in a sealed and an unsealed position, respectively. FIG. 3 depicts a longitudinal, cross-sectional view of a portion of a BOP depicting the door and lock assemblies in greater detail.

The BOP 220 includes a housing 228 with a bore 230 and a channel 232 therethrough. The BOP also includes a ram assembly 224 and a door assembly 225. The ram assembly 224 includes a ram block 234, a ram shaft 236 a ram cylinder 238 and an actuator 240. The ram shaft 236 extends through the ram channel 232. The BOP of FIGS. 2A and 2B is depicted with two opposing ram assemblies 224, but any number may be provided in any direction. The ram block 234 may seal with and/or sever a tubular 216. An example of a ram assembly usable with the BOP is described in U.S. Pat. No. 5,735,502.

The door assembly 225 includes a door 242 that provides access to the channel 232 and the components of the BOP 220. The ram shaft 236 extends through the door 242 and to the ram cylinder 238 external thereto. The door assembly 225 is also provided with a lock 244 with teeth 246 for locking engagement with the housing 228. The lock 244 as shown includes a pair of locking members (or plates) 248 positioned between the door 242 and the housing 228 for interlocking engagement therewith. The lock 244 may optionally be integral with the door 242 or housing 228.

Figure 4A:
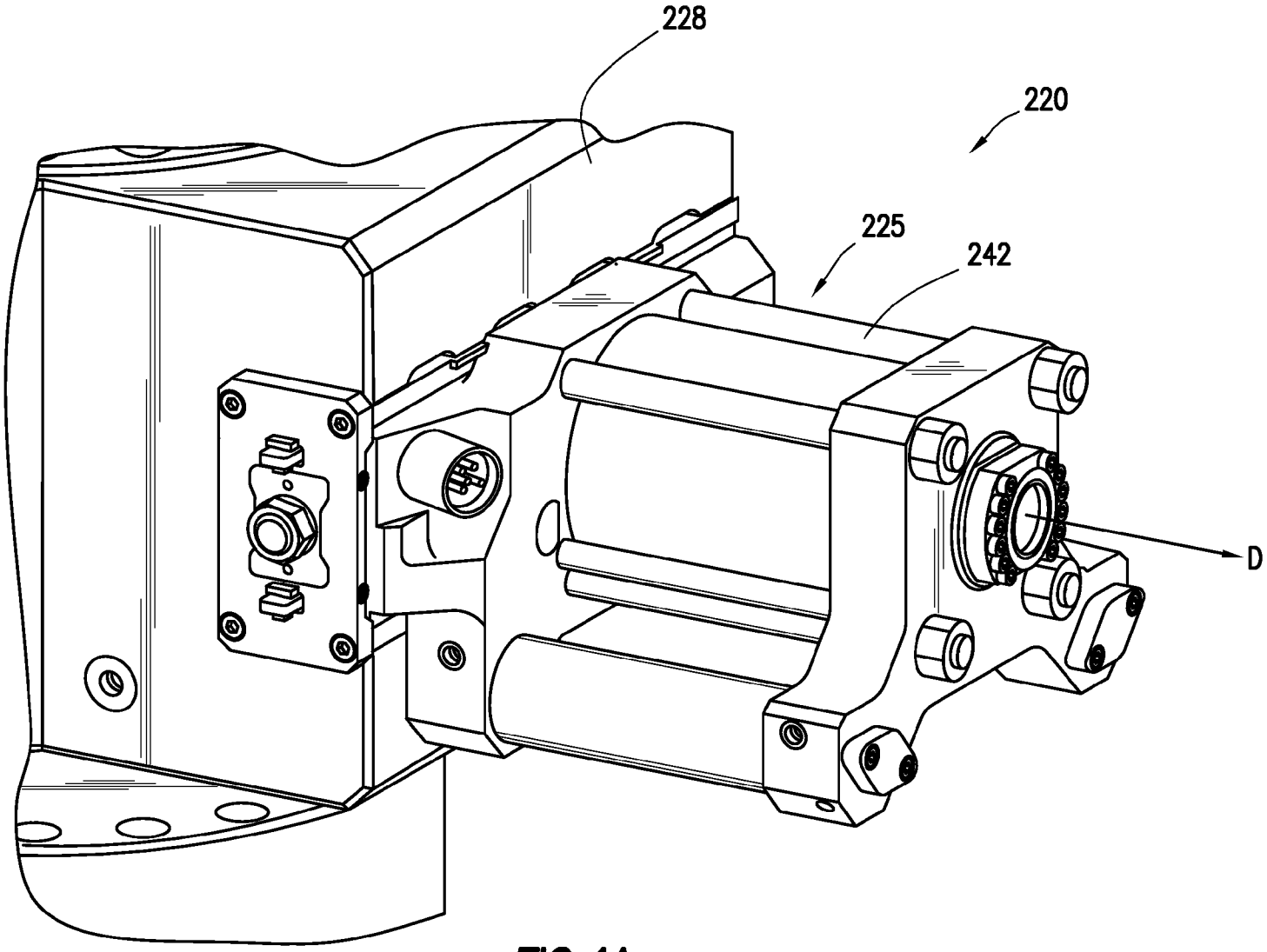
FIGS. 4A-4B depict perspective views of a BOP with a door assembly in a locked and an unlocked position, respectively.
Figure 4B:
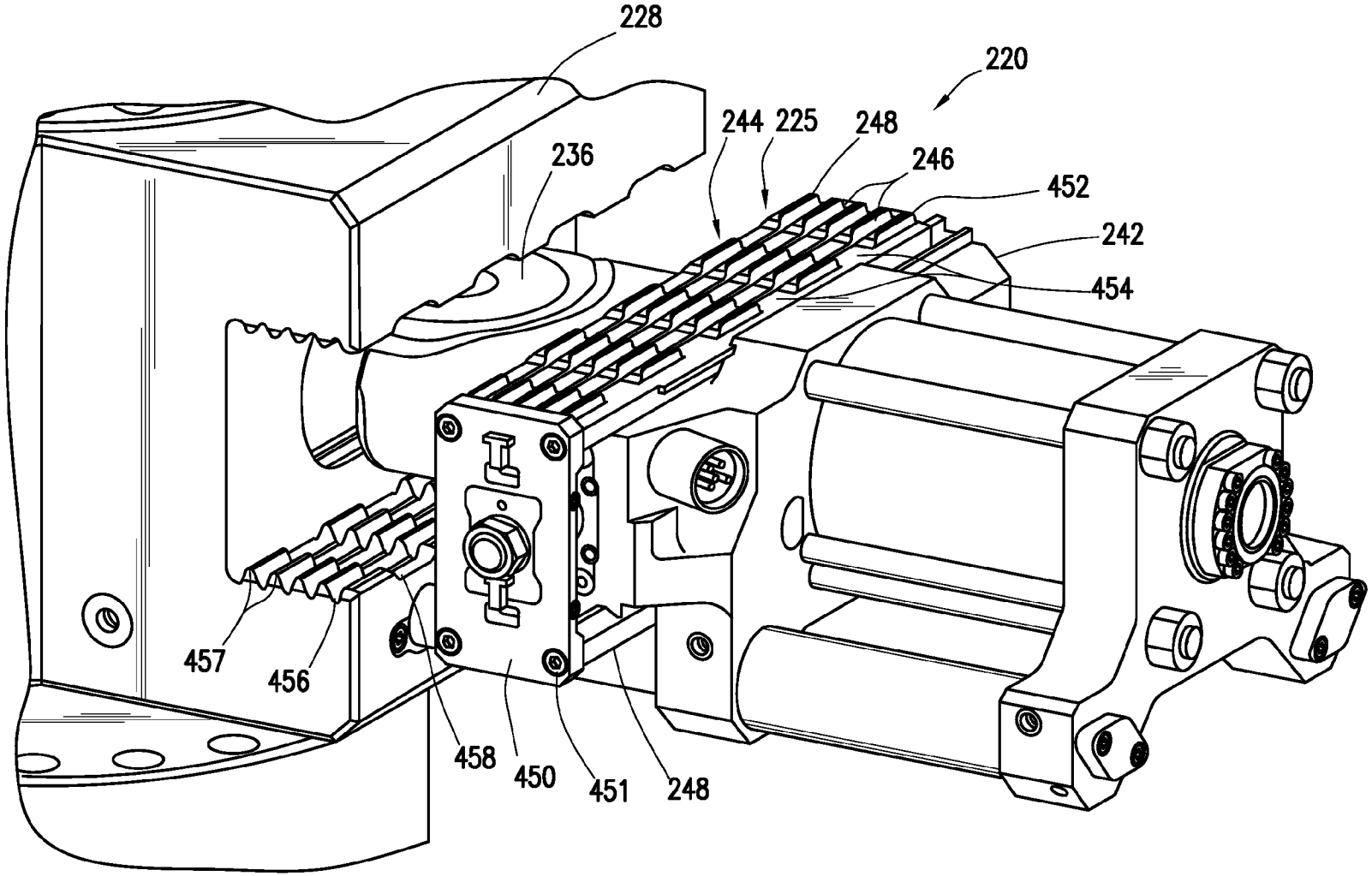

FIGS. 4A and 4B depict perspective views of a portion of the BOP 220 of FIGS. 2A and 2B in a locked and unlocked position, respectively. These figures show the operation of the door assembly 225 in greater detail. The lock 244 includes upper and lower locking members 248 positioned on opposite sides of the door 242. A pair of lock supports 450 are positioned on each end of the pair of locking members 248 and secures them in position about the door 242. Bolts and/or other fasteners 451 may optionally be provided to secure the locking members 248 in a desired position.

The locking members 248 are depicted as being parallel to each other and having identical configurations. Each locking member 248 has a plurality of teeth 246 on a housing surface 452 positionable adjacent to the housing 228. The teeth 246 are positioned along the housing surface 452 in rows with lock trenches 454 therebetween. The teeth 246 are lockingly engageable with corresponding slots 456 and teeth 457 in the housing 220.

The housing 220 may also be provided with housing trenches 458 corresponding to the rows and lock trenches 454 of the locking member 248. The slots 456 matingly engage with the teeth 246. In some versions, the slots 456 may be defined between teeth 457 in the housing 228. The teeth 457 in the housing 228 may be of the same shape as the teeth 246 for mating engagement therebetween.

When positioned with the teeth 246 and slots 456 interlocked as shown in FIG. 4A, the door 242 is maintained in a closed position. When the lock 244 is moved along the door 242 in either direction as indicated by the dual arrows (e.g., in a direction perpendicular to the travel of the ram assembly) to a disengaged position where the teeth 246 align with the housing trenches 458, the door 242 is released and moveable to a retracted position as shown in FIG. 4B. The teeth 246 and the lock trenches 454 are shaped to correspond with slots 456 and housing trenches 458 such that when the locking member 248 is in a lock position, the teeth 246 are in locking engagement with the slots 456 to prevent release of the door 242.

When the locking member 248 is moved to an unlocked position, the teeth 246 are moved into alignment with the housing trenches 458 of the housing and the teeth 457 of the housing are moved into alignment with the lock trenches 454. In this position, the teeth 246 and 457 are free to move and the locking member may slide relative thereto. The door 242 is thereby released to move to an open position. In this manner, the lock 244 moves between the locked and unlocked position by traveling along the door 242 in a direction as indicated by the dual arrow, which is transverse to a retraction direction D of travel of the ram assembly as indicated by the unidirectional arrow.

The locking members 248 may be configured for selective movement between the door assembly 225 and the BOP housing 220. In some cases, the locking members 248 may be made integral with one or the other of the door assembly 225 and the BOP housing 220. In some cases, the locking member 248 may be affixed to or made integrally with one or the other of the door assembly 225 and the BOP housing 220. For example, portions of the door assembly 225 may have teeth engageable with teeth of the BOP housing 220, or portions of the BOP housing 220 may be provided with teeth engageable with teeth of the door assembly 225.

Figure 5A:
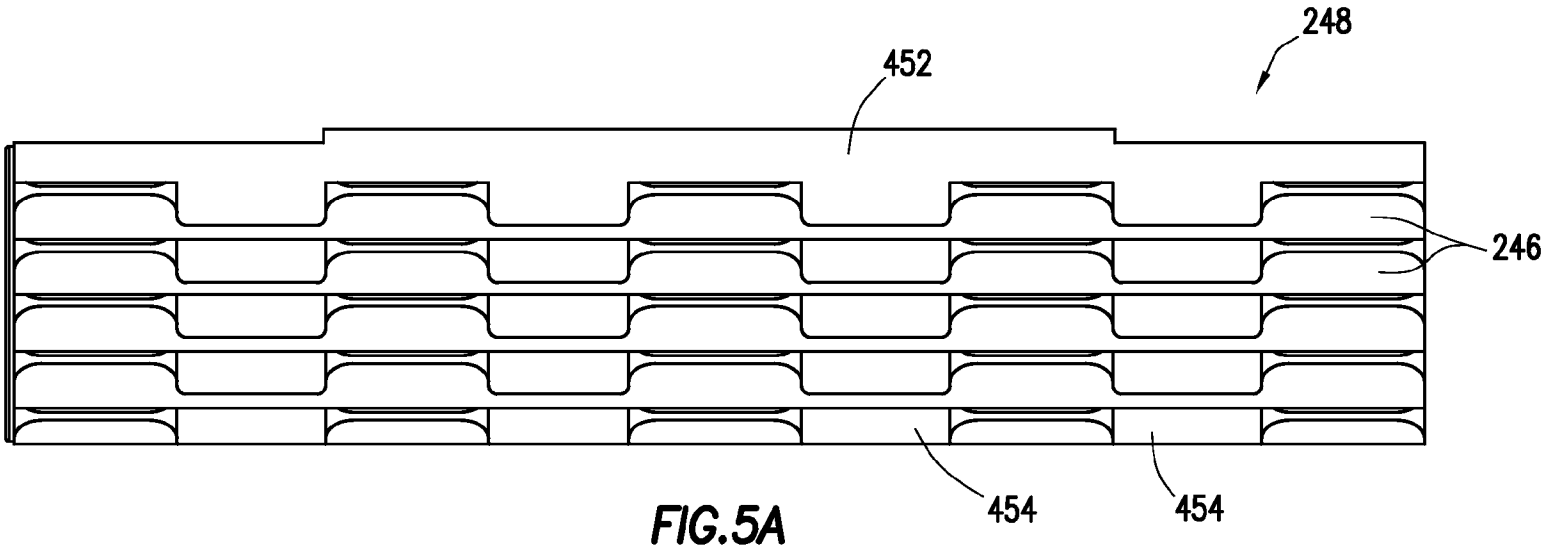
FIGS. 5A-5B depict top and bottom views, respectively, of locking members of the door assembly of FIG. 4B.
Figure 5B:
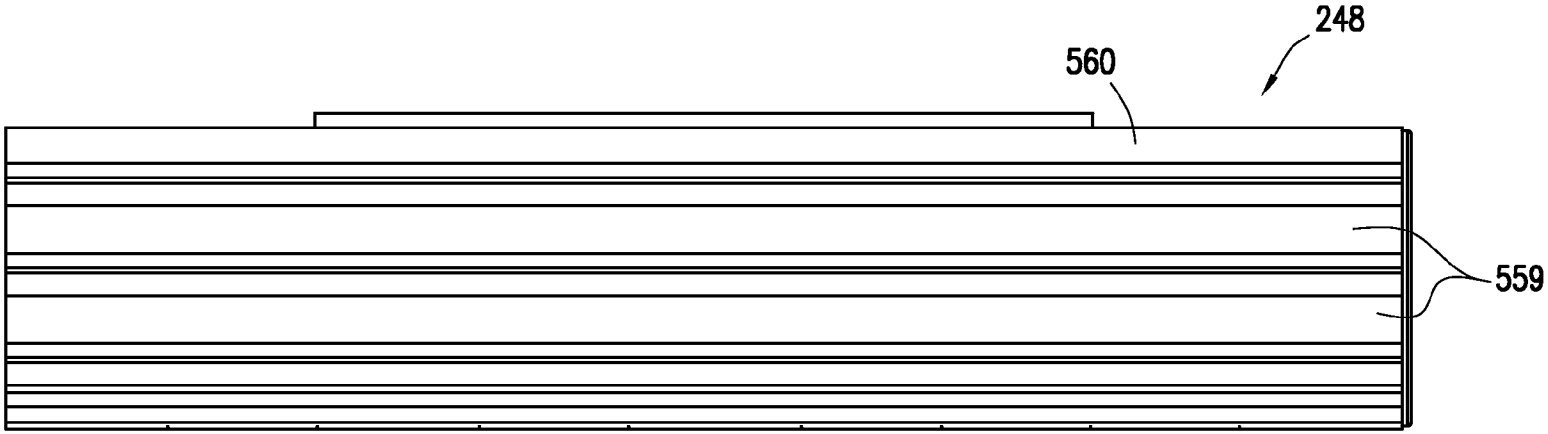

FIGS. 5A and 5B show top and bottom views of the locking members 248. As shown in these views, the teeth 246 are disposed about the housing surface 452 in rows of parallel teeth 246 with lock trenches 454 therebetween. In this version, the plate 248 need only travel a portion of the distance of the length of the plate to provide separation from the adjacent BOP housing.

As shown in FIG. 5B, a plurality of teeth 559 are depicted on a door side 560 of the locking member 248 and extend along the entire length thereof. The teeth 559 on the door side 560 of the locking member 248 may be used to provide locking engagement between the locking member 248 and the door 242. In this version, the plate 248 must travel the entire length of the adjacent door before separation may occur.

While a specific configuration of teeth 246 is shown, a variety of configurations may be provided that permits selective interlocking engagement between the door 242 and the housing 228. For example, the teeth 246 may have trenches 454 as shown in FIG. 5A to facilitate selective opening of the lock as shown in FIG. 5B, or prevent opening. Other configurations may be provided to selectively separate the locking member 248 from the door and or BOP housing.

FIGS. 6A-6E show cross-sectional views of various configurations of door assemblies usable as the door assembly 225. As shown in each of these views, the lock may be of various configurations for providing locking engagement between the door 242 and the BOP housing 228. The shape of the lock and/or teeth 246 may have a variety of shapes, such as polygonal, triangular, trapezoidal, round, etc.

Figure 6A:
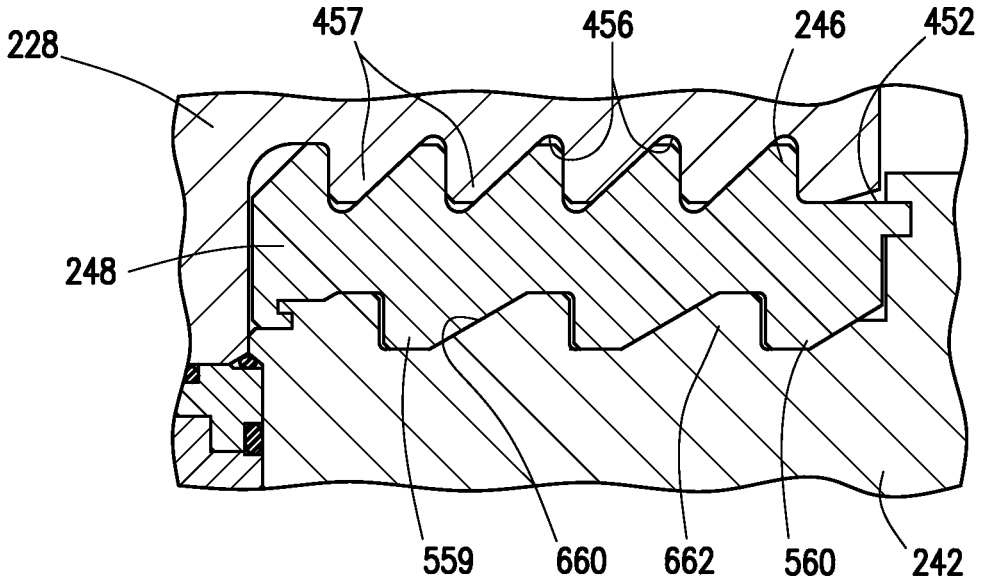
FIGS. 6A-6E depict vertical cross-sectional views of a portion of a BOP with various lock configurations.

FIG. 6A shows the lock 244 of FIGS. 4A-5B in greater detail. As shown in this view, the locking teeth 246 on the housing surface 452 of the locking member 248 are triangular in shape with a slanted side of the triangle at an acute angle 0 to a horizontal axis X of the ram door 242, and a vertical side of the triangle perpendicular to the horizontal axis X of the ram door 242. This buttress configuration of the teeth 246 resists movement of the door 242 in the retraction direction D of travel for the door 242.

As also shown in this view, the slots 456 receivingly engage the teeth 246. The slots 456 define teeth 457 in the buttress configuration to provide a corresponding, interlocking configuration between the locking member 248 and the BOP housing 228. The teeth 559 along the door surface 560 of the locking member 248 may also be provided with various shapes, such as those described with respect to the teeth 246. The door 242 is provided with slots 660 and/or corresponding teeth 662 for receiving the teeth 559.

Figure 6B:
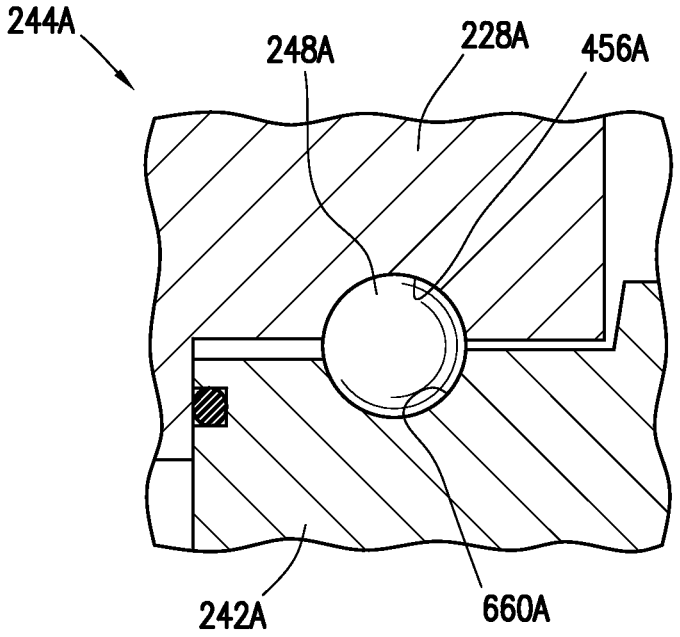
Figure 6C:
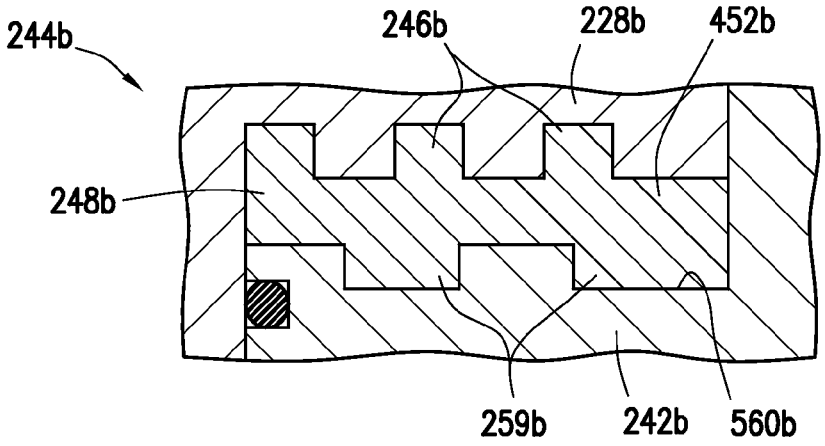

Various numbers of teeth may be provided along the BOP housing, door and/or locking member(s) to achieve the desired resistance to movement. For example, as shown in FIG. 6B, the lock 244*a* may have a locking member (or ball) 248*a*, and the housing 228*a* and the door 242*a* may have slots 456*a* and 660*a* shaped to receive the lock 244*a*. In this case, there is a single slot in each of the housing 228*a* and the door 242*a*. In the version in FIG. 6C, the lock 244*b* includes a locking member 248*b* has rectangular teeth 246*b* on the housing surface 452*b* of the housing 228*b* and rectangular teeth 559*b* on the door surface 560*b* of the door 242*b*. The locking member 248*b* has an asymmetrical configuration with a different number of teeth on each side thereof.

Figure 6D:
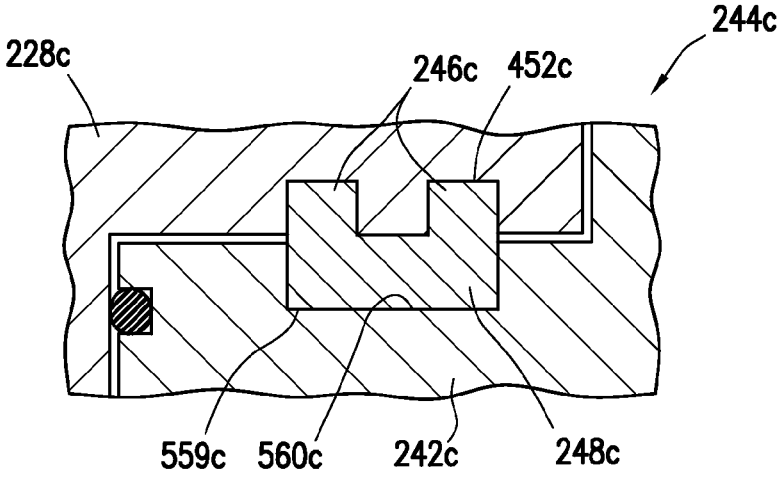
Figure 6E:
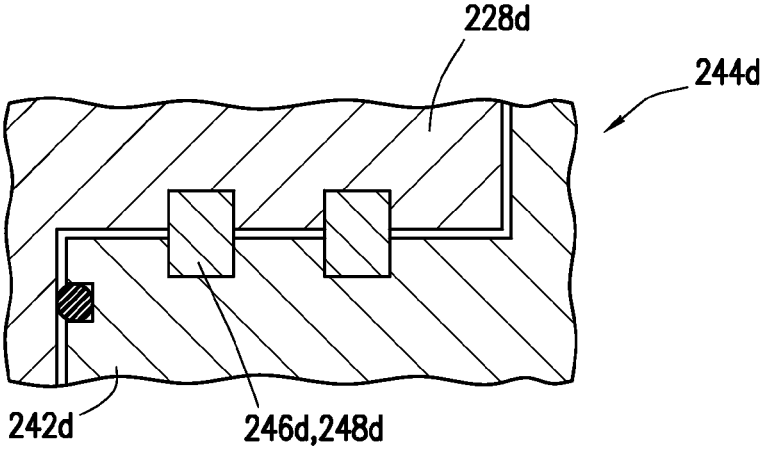

In the version of FIG. 6D the lock 244*c* includes a locking member 248*c* with rectangular teeth 246*c* on the housing surface 452*c* of the lock 248*c* for engaging the housing 228*c* and a single rectangular tooth 559*c* on the door surface 560*c* of the door 242*c*. The locking member 248*c* has an asymmetrical configuration with more teeth 246*c* on the housing surface 452*c* than on the door surface 560*c*. In the version of FIG. 6E, the lock 244*d* includes multiple locking members 248*d* or teeth 246*d* provided between the door 242*d* and the housing 228*d*. Each of the locks 244*d* are symmetrical and have a rectangular cross-section.

It will be appreciated by those skilled in the art that the techniques disclosed herein can be implemented for automated/autonomous applications via software configured with algorithms to perform the desired functions. These aspects can be implemented by programming one or more suitable general-purpose computers having appropriate hardware. The programming may be accomplished through the use of one or more program storage devices readable by the processor(s) and encoding one or more programs of instructions executable by the computer for performing the operations described herein. The program storage device may take the form of, e.g., one or more floppy disks; a CD ROM or other optical disk; a read-only memory chip (ROM); and other forms of the kind well known in the art or subsequently developed. The program of instructions may be "object code," i.e., in binary form that is executable more-or-less directly by the computer; in "source code" that requires compilation or interpretation before execution; or in some intermediate form such as partially compiled code. The precise forms of the program storage device and of the encoding of instructions are immaterial here. Aspects of the invention may also be configured to perform the described functions (via appropriate hardware/software) solely on site and/or remotely controlled via an extended communication (e.g., wireless, internet, satellite, etc.) network.

While the embodiments are described with reference to various implementations and exploitations, it will be understood that these embodiments are illustrative and that the scope of the inventive subject matter is not limited to them. Many variations, modifications, additions and improvements are possible. For example, one or more locks with one or more teeth on either side thereof and in various configurations may be positioned about the door and/or housing, and be made integral therewith or independent therefrom.

Plural instances may be provided for components, operations or structures described herein as a single instance. In general, structures and functionality presented as separate components in the exemplary configurations may be implemented as a combined structure or component. Similarly, structures and functionality presented as a single component may be implemented as separate components. These and other variations, modifications, additions, and improvements may fall within the scope of the inventive subject matter.

What is claimed is:

1. A door assembly for accessing a blowout preventer of a wellsite, the blowout preventer for sealing about a tubular extending from a wellbore of the wellsite, the blowout preventer comprising a housing having a bore and a channel through the housing, the tubular positionable through the bore and engageable in the bore, the door assembly comprising:

a door slidably positionable along an axis of the channel and providing selective access to the channel; and a lock comprising at least one locking member having at least one raised portion extending linearly along a flat surface of the locking member in a direction transverse to the axis of the channel, the at least one raised portion of the at least one locking member extendable into at least one corresponding receptacle extending linearly into a flat surface of the housing, the at least one locking member movable linearly along the at least one corresponding receptacle between an unlocked and a locked position whereby the door assembly is selectively retractable from the housing.

2. The door assembly of claim 1, wherein the at least one locking member comprises at least one locking plate having the at least one raised portion thereon, the at least one raised portion comprising a plurality of teeth comprising a plurality of door teeth and a plurality of housing teeth on opposite sides of the at least one locking plate, the plurality of door teeth being engageable with the door, the plurality of housing teeth being engageable with the housing.

3. The door assembly of claim 2, wherein the housing has a plurality of teeth engageable with the plurality of housing teeth.

4. The door assembly of claim 2, wherein the plurality of teeth have one of a polygonal shape, triangular shape, trapezoidal shape, a round shape and combinations thereof.

5. The door assembly of claim 2, wherein the plurality of teeth are at an acute angle to the axis of the channel.

6. The door assembly of claim 2, wherein the plurality of teeth are distributed in discrete rows.

7. The door assembly of claim 6, wherein the discrete rows have trenches therebetween.

8. The door assembly of claim 7, wherein at least one locking member is slidably movable between the locked position with the plurality of teeth in non-alignment with the trenches of the plurality of teeth of the another of the housing and the door assembly and the unlocked position with the plurality of teeth in alignment with the trenches of the plurality of teeth of the another of the housing and the door assembly.

9. The door assembly of claim 6, wherein a number of the plurality of teeth of the housing and a number of the plurality of housing teeth of the locking plate are the same.

10. The door assembly of claim 6, wherein a number of the plurality of housing teeth of the locking member and a number of the plurality of teeth of the housing are the different.

11. The door assembly of claim 1, wherein the lock comprises a pair of locking members on opposite sides of the door.

12. The door assembly of claim 11, wherein the lock further comprises a pair of lock supports operatively connecting the pair of lock members to the door assembly.

13. The door assembly of claim 1, wherein the at least one locking member comprises a locking ball.

14. The door assembly of claim 1, wherein the at least one raised portion comprises a plurality of parallel door teeth and wherein the at least one corresponding recess is positioned between a plurality of parallel housing teeth.

15. The door assembly of claim 14, wherein the plurality of parallel door teeth and the plurality of parallel housing teeth are positioned in spaced apart columns, the columns being parallel to the axis of the channel.

16. A blowout preventer for sealing about a tubular extending from a wellbore of a wellsite, the blowout preventer comprising:

a housing having a bore and a channel through the housing, the tubular positionable through the bore and engageable in the bore; and a door assembly positionable about an opening of the channel of the housing, the door assembly comprising:

a door slidably positionable along an axis of the channel and providing selective access to the channel; and a lock comprising at least one locking member having at least one raised portion extending linearly along a flat surface of the locking member in a direction transverse to the axis of the channel, the at least one raised portion of the at least one locking member extendable into at least one corresponding receptacle extending linearly along a flat surface of the housing, the at least one locking member movable linearly along the at least one corresponding receptacle between an unlocked and a locked position whereby the door assembly is selectively retractable from the housing.

17. The blowout preventer of claim 16, further comprising a ram block with a ram shaft extended therefrom through the door assembly and into a ram cylinder, the ram block slidably movable through the channel of the housing and sealingly engageable with the tubular.

18. The blowout preventer of claim 17, further comprising an actuator operatively connectable to the ram cylinder.

19. A method of accessing a blowout preventer of a wellsite, the blowout preventer for sealing about a tubular extending from a wellbore of the wellsite, the blowout preventer comprising a housing having a bore and a channel through the housing, the tubular positionable through the bore and engageable in the bore, the method comprising:

providing a door assembly as in claim 1;

selectively retracting the door assembly from the housing by movably positioning the at least one raised portion along the at least one corresponding receptacle of the housing between the locked and unlocked position.

20. The method of claim 19, wherein the at least one raised portion comprises a plurality of teeth and wherein the selectively retracting comprises slidably moving the plurality of teeth between the locked position in non-alignment with trenches of the plurality of teeth of the housing and the unlocked position in alignment with the trenches.

21. The method of claim 19, further comprising slidably positioning a ram assembly in the channel of the housing, the ram assembly comprising a ram block with a ram shaft extended therefrom through the door assembly and into a ram cylinder, the method further comprising accessing the ram assembly by retracting the door assembly.

22. The method of claim 21, further comprising slidingly moving the ram block through the channel of the housing and in sealing engagement with the tubular.

* * * * *